US006259050B1

(12) United States Patent
Zehnder et al.

(10) Patent No.: US 6,259,050 B1
(45) Date of Patent: Jul. 10, 2001

(54) BURN-OFF CONTACT ARRANGEMENT

(75) Inventors: Lukas Zehnder, Baden-Dättwil; Ion Gavrilita, Wettingen; Markus Keller, Dielsdorf; Jörg Peter, Hinwil; Thomas Schoenemann, Buchs, all of (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/445,597

(22) PCT Filed: Apr. 12, 1999

(86) PCT No.: PCT/CH99/00146

§ 371 Date: May 11, 2000

§ 102(e) Date: May 11, 2000

(87) PCT Pub. No.: WO99/53512

PCT Pub. Date: Oct. 21, 1999

(30) Foreign Application Priority Data

Apr. 14, 1998 (DE) ..... 198 16 508

(51) Int. Cl.[7] ..... H01H 33/66

(52) U.S. Cl. ..... 218/118; 218/48; 218/123

(58) Field of Search ..... 218/17–21, 48–50, 218/43, 45, 57, 65–66, 74, 146; 200/245, 248, 287

(56) References Cited

U.S. PATENT DOCUMENTS

| | | | | |
|---|---|---|---|---|
| 1,601,314 | * | 9/1926 | Mahoney | 218/154 |
| 4,205,209 | * | 5/1980 | Thuries et al. | 218/154 |
| 5,981,893 | * | 11/1999 | Bleiker et al. | 218/48 |
| 6,100,489 | * | 8/2000 | Zehnder et al. | 218/17 |

FOREIGN PATENT DOCUMENTS

| | | | |
|---|---|---|---|
| 893830 | | 10/1953 | (DE) . |
| 1 955 490 | | 2/1967 | (DE) . |
| 246 412 | | 6/1987 | (DE) . |
| 3736835 | * | 5/1989 | (DE) . |
| 0 800 191 | | 10/1997 | (EP) . |
| 196 13 568 | | 10/1997 | (DE) . |
| 691621 | | 3/1930 | (FR) . |
| 2 691 574 | | 11/1993 | (FR) . |
| 2-299114 | * | 12/1990 | (JP) . |
| 4-192229 | | 7/1992 | (JP) . |

OTHER PUBLICATIONS

"Kupfer–Beryllium ein Federwerkstoff für Steckerkontakte", Von Günter F. Beck, *Industrie–Elektronik Elektronik*, pp. 695–699. (No date).

"Richtlinien für die Beurteilung von Schalstücken in Expansionsschaltern", *Siemens–Schuckertwerke Aktiengesellschaft*, pp. 3–12 (No date).

* cited by examiner

*Primary Examiner*—Lincoln Donovan
(74) *Attorney, Agent, or Firm*—Burns, Doane, Swecker & Mathis, L.L.P.

(57) ABSTRACT

A switching arrangement having a large burn-up reserve, contact fingers (2) are connected to a first electrical terminal via flexible bands (6) consisting of strips of, for example, copper which lie one above the other. The connecting portion (7) of the band (6), the said connecting portion adjoining the contact fingers (2) and being rigidly connected to them, is reinforced in each case by pressure welding of the strips. In the switch-off state, the bands (6) and, in part, the contact fingers (2) bear on an outwardly pointing supporting face (10), whilst, in the switch-on state, at least the contact fingers (2) and connecting portions (7) are lifted off from the supporting face (10), with the bands (6) being bent at the same time, as a result of contact with the outside of a switching pin (3) displaceable along a switching axis (1). The pressure force caused by electromagnetic attraction between the relatively short contact fingers (2) and the connecting portions (7), which in each case form an angle of approximately 30° with the switching axis (1), approximately compensates the contact lift-off forces, whilst the forces acting on the flexible parts of the bands (6) are absorbed essentially by the supporting face (10).

11 Claims, 1 Drawing Sheet

BURN-OFF CONTACT ARRANGEMENT

BACKGROUND OF THE INVENTION

1. Field of the Invention

The invention relates to a burn-up switching arrangement, in particular for circuit breakers, such as are used in power stations, transformer stations and other facilities for the supply of electrical energy for switching on and off operating currents and overcurrents.

2. Description of the Related Art

Generic burn-up switching arrangements are known (see, for example, DE-A-196 13 568), in which the contact fingers of a contact bell are anchored fixedly, so that the pressure force in the switch-on position is generated merely by the generally low elasticity of the contact fingers. In arrangements of this type, the burn-up reserve is restricted to the initial elastic deflection of the contact fingers.

SUMMARY OF THE INVENTION

By contrast, the object on which the invention is based is to specify a burn-up switching arrangement which has a burn-up reserve not restricted by the material properties of the contact fingers.

This object is achieved by means of a burn-up switching arrangement, in which the contact fingers have a large radial clearance available, so that even a considerable burn-up can be compensated by a suitable variation in the position of the contact fingers.

BRIEF DESCRIPTION OF THE DRAWINGS

The drawing illustrates an exemplary embodiment which serves merely for explaining the invention.

DETAILED DESCRIPTION OF THE PREFERRED EMBODIMENT

Figure 1:
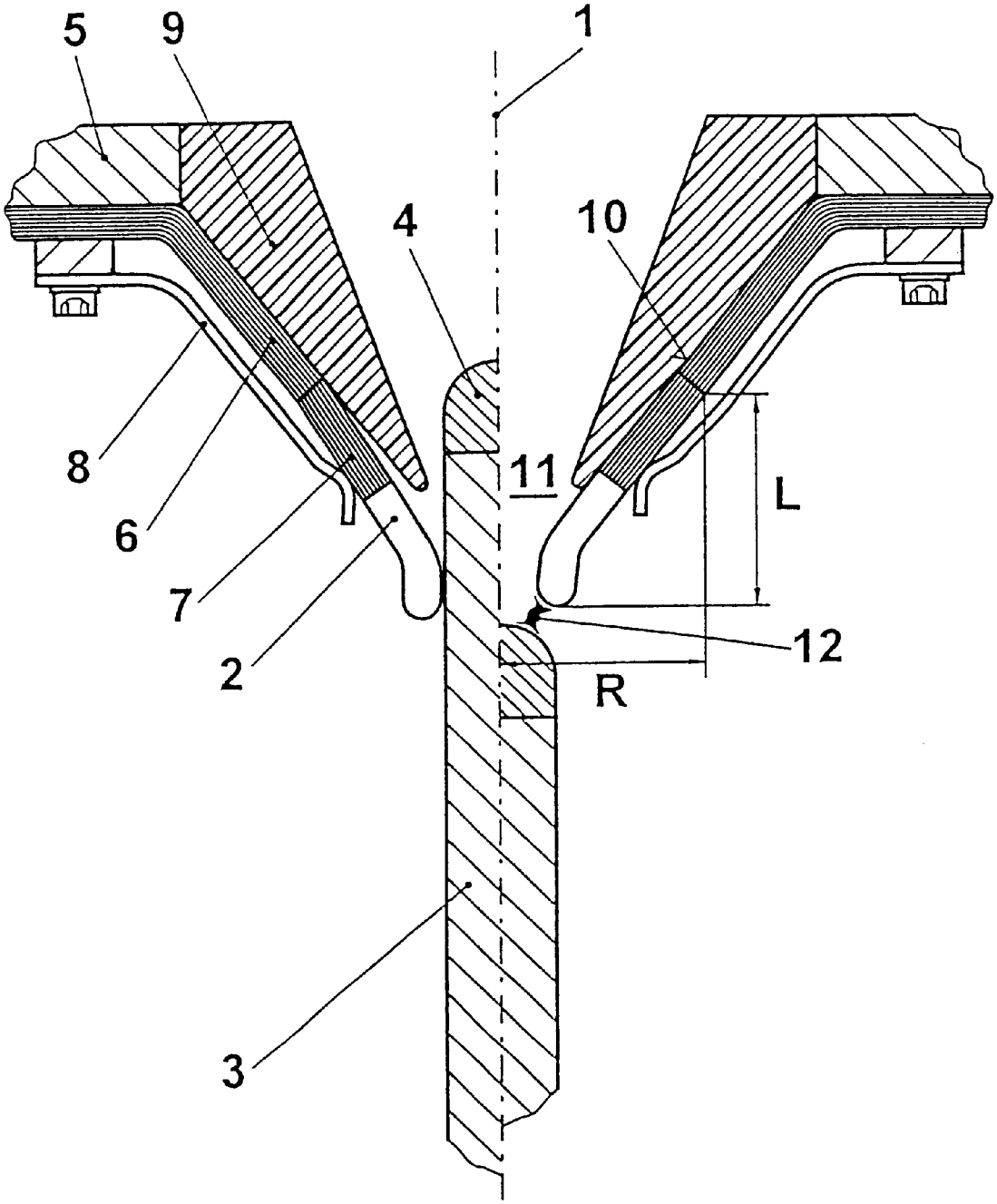
FIG. 1 shows diagrammatically an axial longitudinal section through a burn-up switching arrangement according to the invention, in the switch-on position on the left and in the switch-off position on the right.

The burn-up switching arrangement illustrated in FIG. 1 has, as a first switching piece, a contact bell which is connected to a first electrical terminal and which is composed of a plurality of contact fingers 2 which are arranged around a switching axis 1 and form an angle of approximately 30° with the latter and which consist completely or at least in the region of the burn-up heads of material resistant to burn-up, such as, for example, W/Cu, graphite, CFC, graphite/Cu, CFC/Cu. Provided as a second switching piece is a solid switching pin 3 which has a tip 4 consisting likewise of material resistant to burn-up. The said pin is connected to a second electrical terminal, for example via a sliding bell or a flexible lead, and is displaceable along the switching axis 1, by means of a switching drive (not illustrated), between a switch-on position, in which the contact fingers 2 touch the said pin on its outside, and a switch-off position, in which it is at a distance from these contact fingers.

In the continuation of each contact finger 2, the latter has adjoining it a lead which is preferably welded to it and which connects it electrically conductively to a housing part 5 and, further, to the first electrical terminal. The lead is formed in each case by a band 6 which consists of a plurality of strips of flexible electrically conductive material, for example of copper or a copper-containing alloy, which are laid one above the other. In the region of connecting portions 7 which directly adjoin the contact fingers 2 in the direction of the latter, the bands 6 are in each case reinforced by means of pressure-welding of the strips. Otherwise, however, the strips are not fixedly connected to one another, so that the band 6 is flexible in each case from the outer end of the connecting portion 7 onwards. A leaf spring 8 in each case presses elastically from outside against the connecting portion 7, so that the contact finger 2 is pressed against the switching pin 3 in the switch-on position.

A supporting body 9 consisting of electrically insulating material forms an outwardly pointing supporting face 10 which is in the form of the envelope of a cone frustum and on which, in the switch-off position, in small part, the contact fingers 2 and, in a part extending considerably beyond the connecting portion 7, the bands 6 bear with their insides under the action of the leaf springs 8. Moreover, the said supporting body forms a central nozzle 11 which widens in the switch-on direction and into which the switching pin 3 projects in the switch-on position.

In the switch-on position illustrated on the left, the ends of the contact fingers 2 are pressed against the outer face of the switching pin 3 by the leaf springs 8. At least the contact fingers 2 and the rigid connecting portions 7 adjoining them are lifted off from the supporting face 10 as a,result of contact with the switching pin 3, but, as a rule, a part of the flexible region of the band 6 which adjoins the connecting portion 7 is also thus lifted off. If, after the commencement of a switch-off, the current is commutated from a nominal-current switching arrangement, not illustrated, to the burn-up switching arrangement, then, under the current intensities normally to be expected, the lift-off forces between the switching pin 3 and the contact fingers 2 are approximately compensated by the mutual attraction of the contact fingers 2 which is caused by the axial components of the part-currents flowing through them.

Under very high currents, the flexible portions of the bands 6 are pressed completely against the supporting face 10, as illustrated on the left in FIG. 1, so that the support body 9 absorbs the forces acting on these. Consequently, in each case only those forces which act directly on the relatively short, straight, obliquely set portion which is formed by the contact finger 2 and the connecting portion 7 rigidly continuing the latter and is characterized by the axial length L and the radius R are critical for the pressure exerted on the switching pin 3 by the contact finger 2. This avoids the situation where the said pressure assumes undesirably high values leading to high abrasion and impeding the switch-off movement.

As the switch-off movement continues, an arc 12 is thrown between the switching pin 3 and the contact fingers 2 and is extinguished by blowing, thus causing a gas stream through the nozzle 11. The shortening of the contact fingers 2 by burn-up is readily compensated in that the angle between the switching axis 1 and the rigid portion consisting of the contact finger 2 and connecting portion 7 in the switch-on position is correspondingly increased. This adaptation of the position of the contact fingers 2 is possible as long as the said portion does not bear on the supporting face 10, so that the burn-up reserve is very high, as may be inferred immediately, above all, from the right-hand side of FIG. 1.

Many modifications of the exemplary embodiment described are possible within the scope of the invention. Thus, for example, the angle of the supporting face and therefore also the upper limit of the angle of the contact fingers with the switching axis may. be selected differently. It is preferably between 15° and 45°, with the switching axis taken in the switch-on direction. The switching pieces may also be supplemented by other components, for example, in each case, a burn-up ring may be provided, which precedes the contact bell or, in the switch-off position, the switching pin, or a burn-up ring of this type may also be arranged on only one side.

What is claimed is:

1. A burn-up switching arrangement, with a first switching piece which, in a switch-on position, is connected to a first electrical terminal and which comprises a contact bell with a plurality of contact fingers, and with a second switching piece which, in the switch-on position, is connected to a second electrical terminal and which comprises a switching pin which can be moved relative to the first switching piece, along a switching axis, between the switch-on position, in which the contact fingers of the contact bell touch the switching pin on its outside, so that the burn-up switching arrangement closes a current path between the first terminal and the second terminal, and a switch-off position, in which the switching pin is at a distance from the first switching piece, the contact fingers of the contact bell being connected to the first electrical terminal via a flexible lead which allows a change in an angle between a longitudinal axis of the contact fingers and the switching axis, and at least one supporting face being provided for supporting at least part of the flexible lead, wherein the at least one supporting face is formed by a continuous outside of a supporting body, in that the supporting body includes electrically insulating material at least in the at least one supporting face, and in that an inside of the supporting body is an insulating nozzle widening in the switch-on direction, said supporting body being positioned so as to prevent inward elastic action of the contact fingers toward the switching axis.

2. The burn-up switching arrangement according to claim 1, wherein the flexible lead includes a plurality of bands including flexible electrically conductive material.

3. The burn-up switching arrangement according to claim 1, wherein each band directly adjoins a contact finger.

4. The burn-up switching arrangement according to claim 2, wherein each band includes a plurality of strips of the flexible electrically conductive material which are laid one above the other.

5. The burn-up switching arrangement according to claim 2, wherein the flexible electrically conductive material is copper or a copper-containing alloy.

6. The burn-up switching arrangement according to claim 2, wherein the strips of a band are in each case connected to one another at a connecting portion adjoining the contact finger.

7. The burn-up switching arrangement according to claim 1, wherein the contact fingers are substantially straight and in each case form an angle with the switching axis.

8. The burn-up switching arrangement according to claim 7, wherein the angle between a longitudinal axis of the contact finger and the switching axis in the switch-on direction is in each case between 15° and 45°.

9. The burn-up switching arrangement according to claim 1, wherein the contact fingers uniformly surround the switching axis.

10. The burn-up switching arrangement according to claim 1, wherein it has, for each contact finger, at least one pressure element which, in the switch-on position, subjects the contact finger to a pressure force directed towards the switching pin.

11. The burn-up switch arrangement according to claim 6, wherein the strips of a band are in each case connected to one another by pressure welding.

* * * * *